United States Patent [19]

Nicholson

[11] 4,020,883

[45] May 3, 1977

[54] FEED WORKS FOR ROTARY RING LOG BARKERS

[75] Inventor: Thomas W. Nicholson, Bellevue, Wash.

[73] Assignee: Nicholson Manufacturing Company, Seattle, Wash.

[22] Filed: Apr. 30, 1976

[21] Appl. No.: 682,124

[52] U.S. Cl. ..... 144/208 E; 144/242 D; 198/793; 226/170

[51] Int. Cl.[2] ..... B27L 1/00; B65H 17/34

[58] Field of Search ..... 226/170, 171; 198/793; 144/208 R, 208 E, 242 R, 242 D, 249, 246 R

[56] References Cited

UNITED STATES PATENTS 3,058,500 10/1962 Smith ..... 144/208 E

*Primary Examiner*—Othell M. Simpson
*Assistant Examiner*—W. D. Bray
*Attorney, Agent, or Firm*—Robert W. Beach

[57] ABSTRACT

Chain type log transports are located at the infeed and outfeed sides, respectively, of a rotary barking ring and are constructed to be positioned as close as possible to the barking ring to transport logs of minimum length through the barking ring. The transports include flights with centrally depressed portions, which flights are mounted by their tips on spaced conveyor chains so as to minimize the radius of the arcs traversed by the flights adjacent to opposite sides of the log-barking ring to enable the flights to be placed as close as possible to the log-barking ring. The radius of the arcuate flight paths is further minimized by the flights being tapered in cross section away from their log-cradling sides to avoid interference between adjacent flights as they turn through their arcuate paths adjacent to the opposite sides of the log-barking ring.

6 Claims, 7 Drawing Figures

Fig. 4.
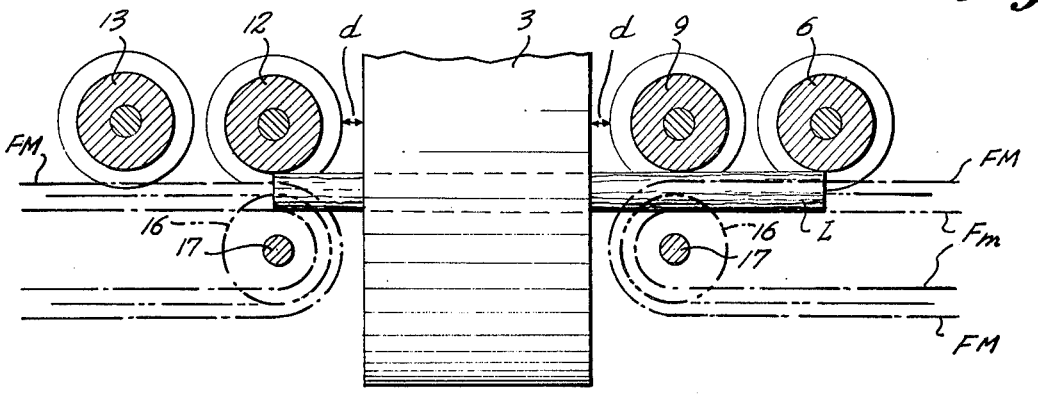
Fig. 4a.
PRIOR ART
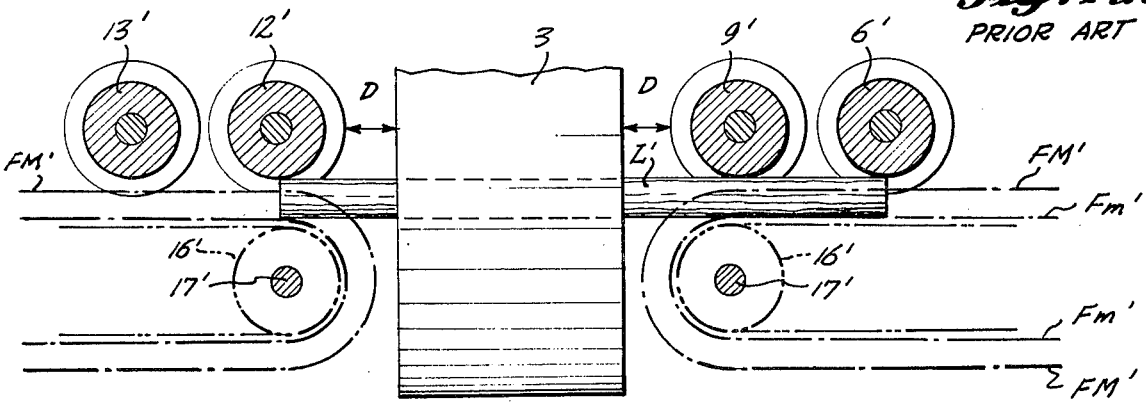
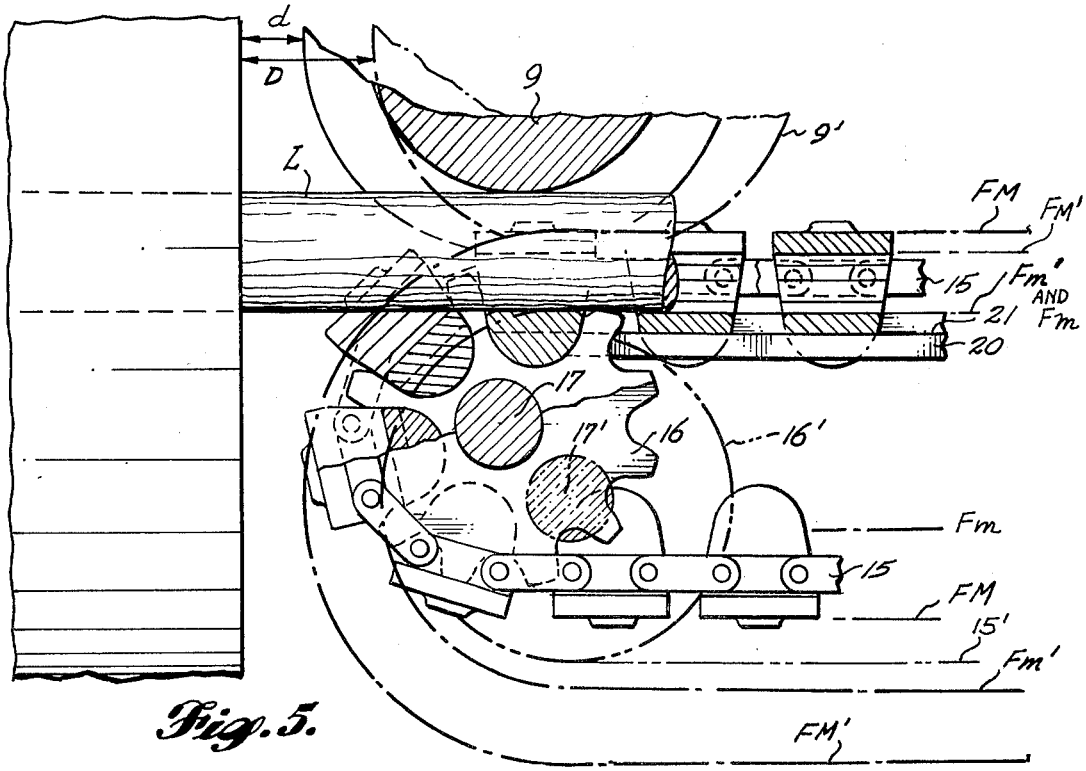
Fig. 5.

FEED WORKS FOR ROTARY RING LOG BARKERS

BACKGROUND OF THE INVENTION

1. Field of the Invention

This invention relates to feed works of the log-transporting chain type for rotary ring log barkers, and more particularly to such feed works for feeding logs of minimum length through such a barker.

2. Prior Art

Feed works for rotary ring barkers including chain-type transporting conveyors operating in combination with hold-down rollers have been used heretofore, such as shown in U.S. Pat. Nos. 2,821,220 and 2,923,333. Such feed works are satisfactory for feeding long logs, but the feed works of the present invention is designed particularly to enable logs of minimum length, as well as longer logs, to be fed satisfactorily through a rotary ring log barker.

SUMMARY OF THE INVENTION

A principal object of the present invention is to enable logs of minimum length to be fed through a rotary ring log barker by locating infeed and discharge log-transporting means of the chain type as close as possible to the rotary log-barking ring of a rotary ring log barker.

A further object is to locate the log-transporting means close to the barking ring of a barker without sacrificing the strength of the log-transporting means or decreasing its effectiveness of operation.

Another object of the invention is to provide log-transportation means which can support a log closer to a rotary barking ring without increasing the complexity or manufacturing expense of the log-transporting means appreciably.

The foregoing objects can be accomplished by mounting the tips of centrally depressed log-cradling flights on chains so that the arcuate path of substantially all portions of each log-cradling flight inwardly of the chains adjacent to the rotary log-barking ring will be smaller than the arcuate path of the flight-carrying chains.

BRIEF DESCRIPTION OF THE DRAWINGS

FIG. 4 is a somewhat diagrammatic longitudinal section through the central portion of a rotary ring log barker to which the present invention is applied, and FIG. 4*a* is a corresponding vertical section through the central portion of a log barker equipped with prior art feed works.

FIG. 5 is a fragmentary longitudinal vertical section through the central portion of a rotary ring log barker equipped with feed works of the present invention, and showing diagrammatically in phantom prior art feed works for comparison.

DETAILED DESCRIPTION

Figure 1:
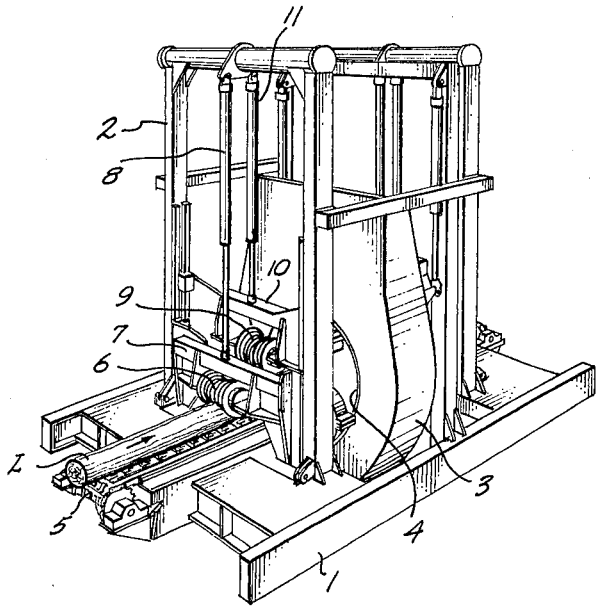
FIG. 1 is a top perspective of a representative type of rotary ring log baker in which the present invention is incorporated.

A rotary ring log barker of a type in conjunction with which the present invention can be used is shown in FIG. 1 as including a base 1 and superstructure 2. The housing 3 houses the rotary barking rng 4. The log feed works 5 feeds logs to the infeed side of the log barking ring 4 and extracts logs from the barking ring outfeed side. The feed works includes generally an infeed log-transporting chain conveyor with which hold-downrolls cooperate and an outfeed log-transporting chain conveyor with which other hold-down rolls cooperate, such mechanism being shown in greater detail in FIGS. 2, 3, 4 and 5.

In FIG. 1 the infeed feed works is shown as having a hold-down roll 6 carried by a mounting 7 that is held down by a fluid-pressure jack 8. Beyond the roll 6 in the direction of log feed is a second hold-down roll 9 carried by a mounting 10 that is held down by a fluid-pressure jack 11. At the discharge side of barking ring 4 are hold-down rolls 12 and 13 arranged in series as shown in FIG. 4, each of which can be pressed downward by fluid-pressure jacks similar to the jacks 8 and 11.

Figure 2:
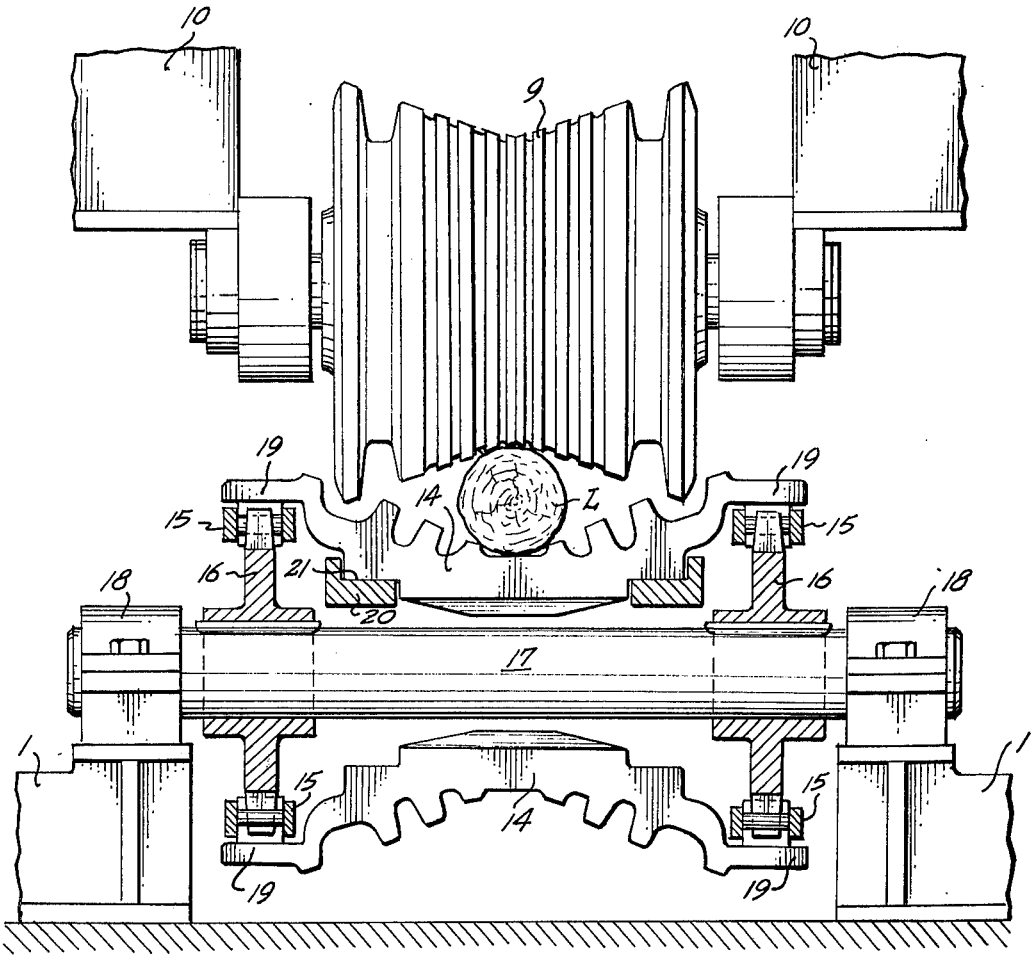
FIG. 2 is a vertical section through the log feed works.

The log-transporting chain conveyor at each side of the log-barking ring includes flights 14 having log-cradling sides provided with log-gripping lugs, the central portions of which flights are depressed, as shown in FIG. 2. Such flights are carried by parallel roller chains 15 that are engaged with sprockets 16 carried by a shaft 17. Such shaft is mounted in pillow blocks 18.

FIG. 4 shows the arrangement of log-transporting chain conveyors and hold-down rolls relative to the casing 3 of the rotary log-barking ring 4, according to the present invention, and FIG. 4*a* shows corresponding feed works and rotary barker ring casing according to the prior art. In the prior art barker the hold-down rolls 6', 9', 12' and 13' correspond to the hold-down rolls 6, 9, 12 and 13, respectively, of the feed works according to the present invention shown in FIG. 4. In FIG. 4 the axles of the log-transporting chain conveyors are designated 17, whereas in FIG. 4*a* the axles of the prior art log-transporting chain conveyors are designated 17'.

In FIGS. 4 and 4*a* the outfeed hold-down rolls 12, 13 and 12', 13' occupy the same relationship lengthwise of the logs L and L'. Also the relationship lengthwise of the log between the axis of hold-down roll 12 and the axis of shaft 17 is the same in FIG. 4 as the relationship between the axis of the hold-down roll 12' and the axis of shaft 17' shown in FIG. 4*a*. The clearance between the maximum arcuate path of the chain flights 14, represented by the outer dot-dash line FM', mounted on the chains 15' carried by the sprockets 16' on axle 17' and the case 3 of the log-barking ring 4 is the same as the clearance between the arcuate path of the flights 14' mounted on the chains 15 engaged with the sprockets 16 on shaft 17 and the casing 3 of the log-barking ring 4 shown in FIG. 4. It will be seen, however, that the clearance *d* between the left side of the log-barking ring casing 3 and the hold-down roll 12' in FIG. 4*a* is considerably greater than the clearance D between the left side of the log-barking ring casing 3 and the hold-down roll 12 in FIG. 4.

The relationship lengthwise of log L' between the hold-down rolls 6' and 9' and the axle 17' of the log-transporting chain conveyor shown in FIG. 4*a* is the same as the relationship between the hold-down rolls 6 and 9 and the log-transporting chain conveyor shaft 17 shown in FIG. 4. Again, however, there is considerably greater clearance D between the hold-down roll 9' and the right side of the barking ring casing 3 shown in FIG. 4a than there is between the hold-down roll 9 and the right side of the barking ring casing 3 shown in FIG. 4. Expressed in another way, the spacing *d* between the hold-down roll 9 and the right side of the barking ring casing is equal to the spacing *d* between the left side of the barking ring casing 3 and the hold-down roll 12. Similarly, the spacing D between the hold-down roll 9' and the right side of the barking ring casing 3 in FIG. 4a is the same as the spacing D between the hold-down roll 12' and the left side of the barking ring casing 3.

A comparison of FIGS. 4 and 4a will show that a log L which can be fed through the barker by the feed works illustrated in FIG. 4 is shorter than the log L' shown in FIG. 4a which is of minimum length for feeding reliably through the barker using the feed works shown in FIG. 4a. In being fed through a log barker in the manner illustrated in FIG. 4 or FIG. 4a, a log must be gripped in cantilever fashion by the feed works at one side of the barking ring 4 or must span between the feed works at opposite sides of the barking ring. Almost up to the point illustrated in FIGS. 4 and 4a, the log L and the log L' have been supported in cantilever fashion by the infeed feed works, and the leading end of the log has just reached a position to be supported by the discharge feed works. Such cantilever support is afforded by the log being gripped between the two upper hold-down rolls 6 and 9 or 6' and 9' and the flight 14 or 14'. With the leading end of the log L in the position shown in FIG. 4, it will be seen that the trailing end of the log is just leaving the hold-down roll 6. Correspondingly, the trailing end of the log L' shown in FIG. 4a is just leaving the hold-down roll 6'. The length of the log L' in FIG 4a is longer than the length of the log L shown in FIG. 4 to the same extent that the spacing D between the hold-down roll 9' and the right side of the barking ring casing 3 exceeds the distance *d* between the hold-down roll 9 and the right side of the barking ring casing 3, plus the extent to which the spacing D between the hold-down roll 12' and the left side of the barking ring casing 3 in FIG. 4a exceeds the spacing *d* between the hold-down roll 12 and the left side of the barking ring 4 in FIG. 4.

The spacing *d* between the hold-down roll 9 or 12 and the barking ring casing 3 in FIG. 4 is less than the spacing D between the hold-down roll 9' or 12' and the barking ring casing 3 in FIG. 4a because of the construction of the log-transporting chain conveyor which enables the conveyor sprocket axle 17 shown in FIG. 4 to be located closer to the barking ring casing 3 than the axle 17' shown in FIG. 4a, while affordng the same clearance between the conveyor chains and the barking ring.

Figure 3:
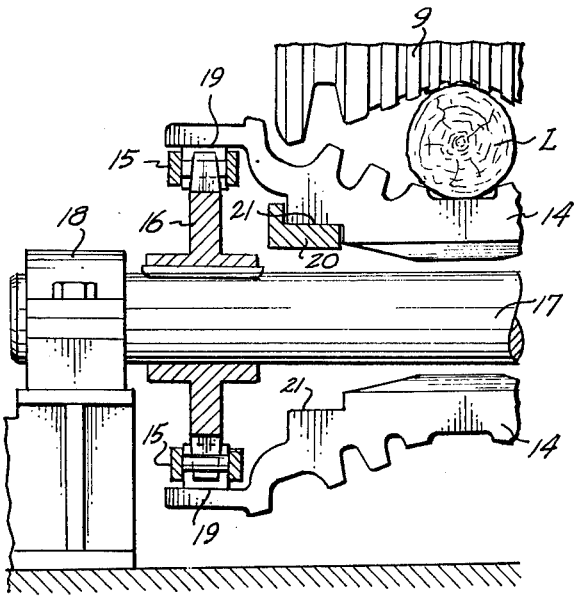
FIG. 3 is a vertical section through log feed works like FIG. 2 with parts broken away.

The spacing between the log-transporting chain conveyor sprocket axles 17 and 17' and the sides of the barking ring casing 3 depends on the maximum radius of the arcuate path around which the log-transporting chain conveyors turn the flights adjacent to the barking ring casing. The roller chain 15 used in the chain conveyor structure of the present invention shown in FIG. 3 is the same as the roller chain 15' of the prior art chain conveyor structure shown in FIG. 3a. To carry such chain there is a minimum practical size of sprocket, and the sprocket 16 used for the chain conveyor in the present invention shown in FIG. 3 is the same as the sprocket 16' used in the prior art conveyor shown in FIG. 3a.

Figure 3A:
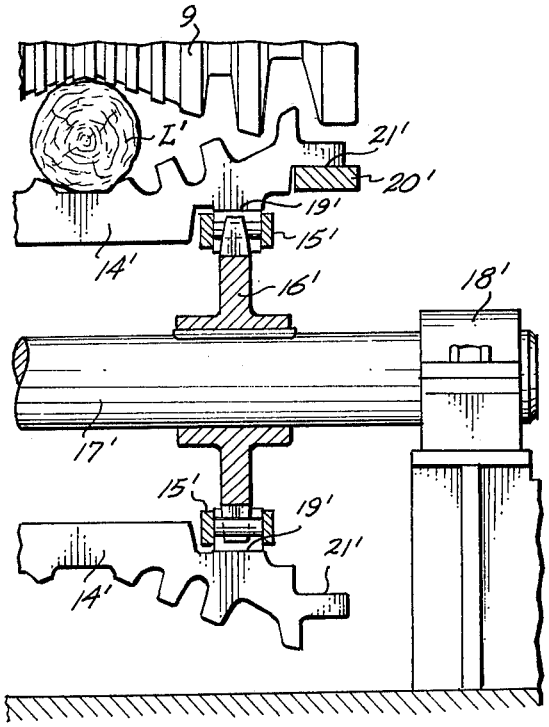
Fig. 3a. PRIOR ART
FIG. 3*a* is a corresponding vertical section through prior art log feed works.

Moreover, the chain conveyor flights 14 used in the chain conveyor structure of the present invention shown in FIG. 3 have, or may have, substantially the same profile as the flights 14' used in the prior art chain conveyor structure shown in FIG. 3a. In both instances the central portion of the log-cradling side of the flight is depressed and has lugs engageable with the surface of a log for driving engagement therewith. The shaft 17' mounted in pillow block 18' and carrying sprockets 16', as shown in FIG. 3a, is the same as the shaft 17 carrying sprockets 16 and journaled in pillow block 18. The advantages of the present invention are accomplished by the manner in which the flights of the log-transporting chain conveyors are mounted on the chains carrying such flights and the manner in which such flights are otherwise supported.

Comparing the log L of FIG. 4 with the log L' of FIG. 4a, it will be seen that the left leading ends of the two logs are in alignment, whereas the right trailing end of the log L' in FIG. 4a is located to the right of the trailing end of the log L shown in FIG. 4, by a distance equal to the sum D plus D of the greater clearances between hold-down rolls 9' and 12' and the barking ring casing 3 in FIG. 4a over the clearances *d* plus *d* between the hold-down rolls 9 and 12 and the barking ring casing 3 in FIG. 4. Consequently the barker shown in FIG. 4 can bark satisfactorily a log L shorter than the log L' of FIG. 4a by the amount of twice D minus *d*.

The point at which each flight 14 or 14' of the infeed works begins to move arcuately should be spaced just slightly less from the barking ring casing 3 than the point of contact with a log L or L' of the hold-down roller 9 or 9' is spaced from the barking ring casing. Consequently, the controlling characteristic of barker feed works in determining the minimum length of log which can be fed satisfactorily through the barker is the maximum radius of the arcuate path FM or FM' traversed by any part of a flight 14 or 14' adjacent to the barking ring casing, corresponding to the engagement of chain 15 or 15' through an 180° arc of sprocket 16 or 16'. Adequate clearance must be left between such flights and the barking ring casing to allow refuse pieces to move between these two parts.

The structure of the present invention minimizes the radius of the arcuate path of flights 14 adjacent to the barking ring casing 3 by mounting the tips 19 of the flights on the conveyor chains 15, as shown in FIGS. 2 and 3, instead of mounting an inwardly located portion 19' of the flights 14' on the carrier chain 15' as shown in FIG. 3a. Because the flights 14 have depressed log-cradling central portions, the tip portions 19 in FIG. 3 will follow a path FM including an arc of larger radius than any other portion of the log-cradling side of the flight during its movement around the 180° arcuate path adjacent to the barking ring. The depressed central portions of the log-cradling sides of flights 14 will follow the path Fm, shown in FIG. 4, and the central portion of the log-cradling sides of flights 14' will follow the path Fm', shown in FIG. 4a.

By mounting the tips 19 of the centrally depressed flights 14 on chains 15, the maximum arc of any portions of flights 14 is substantially equal to the minimum practical arcuate path for chains 15 and the point at which the linear log-supporting path of any flight changes to an arcuate, nonsupporting path can be located as close as practical to the barking ring casing 3.

In order to prevent interference between the central portions of the flights 14 during their movement around the arcuate portion of their path, it is preferable for the central portions of the flights to be tapered in cross section away from their log-cradling sides as shown in FIG. 5, or at least for the inner portions of the adjacent sides of the flights to be cut back by rounding or chamfering.

In prior art log feed works, supporting structure has been provided for the log-supporting flights in addition to the conveyor chains 15'. Such supports have been provided as rails 20' along which sliding surfaces 21' of the flight tips moved. In the construction of the present invention parallel flight-supporting rails 20 are provided, located inwardly of the conveyor chains 15, along which sliding portions 21 of the flights 14 move.

By mounting the tips 19 of the flights 14 on the conveyor chains 15, the log-transporting chain conveyors and their cooperating hold-downs can be located considerably closer to the barking ring casing 3, as shown in FIG. 4, than would otherwise be possible, as illustrated by FIG. 4*a*. where the same clearances between the feed works and the barking ring casing 3 and between portions of the feed works sections at each side of the barking ring casing are provided and where the components of the feed works are substantially the same size and strength. Consequently, as described above, feed works of the present invention can reliably feed through the barking ring logs substantially shorter than can be fed reliably by the type of prior art feed works illustrated in FIGS. 3*a* and 4*a*.

I claim:

1. In feed works for feeding logs to and extracting such logs from a rotary ring type log barker including a rotary barking ring, log-supporting infeed chain means at the infeed side of the barking ring, hold-down means cooperating with the infeed chain means, log-supporting extracting chain means at the outfeed side of the barking ring, hold-down means cooperating with the extracting chain means, and power means for driving the infeed chain means and the extracting chain means conjointly, the infeed chain means and the extracting chain means each including two parallel chains spaced transversely of the direction of movement of the chains and carrying closely spaced log-transporting flights having log-cradling sides with depressed central portions and sprockets adjacent to the barking ring engageable with the chains for supporting them, the improvement comprising flight-mounting means mounting the flights on the chains at locations on the flights such that the arcuate path of said flight-mounting means around the axes of the sprockets is of a radius greater than the radius of the arcuate path of the central portions of the log-cradling sides of the flights around the axes of the sprockets.

2. In the feed works defined in claim 1, the flight-mounting means mounting the tip portions of the flights on the chains.

3. In the feed works defined in claim 1, the flights being tapered in cross section away from their log-cradling sides.

4. In the feed works defined in claim 1, flight-supporting means located between the chains.

5. In the feed works defined in claim 4, the flight-supporting means including rail means supporting the flights for sliding therealong.

6. In the feed works defined in claim 5, the rail means including two parallel rails spaced apart a distance less than the spacing of the chains.

* * * * *